US006504512B2

(12) United States Patent
Tabata

(10) Patent No.: US 6,504,512 B2
(45) Date of Patent: Jan. 7, 2003

(54) GLASS ANTENNA FOR AN AUTOMOBILE

(75) Inventor: Kohji Tabata, Aichi (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/885,117

(22) Filed: Jun. 21, 2001

(65) Prior Publication Data

US 2001/0054982 A1 Dec. 27, 2001

(30) Foreign Application Priority Data

Jun. 22, 2000 (JP) ..... 2000-187715
Oct. 23, 2000 (JP) ..... 2000-322820

(51) Int. Cl.[7] ..... H01Q 1/32
(52) U.S. Cl. ..... 343/713; 343/704
(58) Field of Search ..... 343/704, 711, 343/712, 713; H01Q 1/32

(56) References Cited

U.S. PATENT DOCUMENTS 5,017,933 A 5/1991 Sakurai et al. ..... 343/713
5,343,214 A * 8/1994 Hadzoglou ..... 343/713
5,760,744 A * 6/1998 Sauer ..... 343/700 MS
5,936,585 A * 8/1999 Hall ..... 343/713
6,025,784 A * 2/2000 Mish ..... 343/693.5

FOREIGN PATENT DOCUMENTS

| | | |
|---|---|---|
| DE | 42 16 376 | 11/1993 |
| DE | 195 27 304 | 10/1996 |
| EP | 0 418 047 | 3/1991 |
| EP | 0 542 473 | 5/1993 |
| JP | 2-113414 | 9/1990 |
| JP | 2000-286625 | 10/2000 |
| JP | 2001-7624 | 1/2001 |
| JP | 2001-68915 | 3/2001 |

* cited by examiner

*Primary Examiner*—Tho Phan

(57) ABSTRACT

A glass antenna for an automobile that can improve sensitivity in an FM broadcast band and a frequency band region higher than the FM broadcast band, in which a defogger 3 and an antenna conductor 4 are provided in a rear window glass sheet 1. A vertical portion of the antenna conductor 4 crosses or overlaps a plurality of heater strips 2, and the antenna conductor 4 and the heater strips 2 are laid one upon another by interposing an insulation layer 15 in the crossing or overlapping portion.

16 Claims, 12 Drawing Sheets

GLASS ANTENNA FOR AN AUTOMOBILE

BACKGROUND OF THE INVENTION

1. Field of the Invention

The present invention relates to a glass antenna for an automobile which is suitable for receiving signals in an FM broadcast band (76 to 90 MHZ) or a frequency band region having a higher frequency than the FM broadcast band.

2. Related Art

FIG. 2 shows a conventional glass antenna for an automobile adapted to receive signals in an FM broadcast band or a frequency band region having a higher frequency than the FM broadcast band in which an electric heating type defogger comprising heater strips 2 and bus bars 5*a*, 5*b* is provided in a rear window glass sheet 1 of an automobile, and an antenna conductor 14 is provided in a space above the defogger 3 in the rear window glass sheet 1.

The length of the antenna conductor 14 for receiving signals in the FM broadcast band is different from the length of the antenna conductor 14 for receiving signals in a higher frequency band than the FM broadcast band, and the length of the antenna conductor 14 for receiving signals in a higher frequency band than the FM broadcast band is short. Received signals induced in the antenna conductor 14 are supplied to a receiver 20 via a power feeding point 14*a* and a cable 25. A direct current is fed from a direct current power source 10 to the defogger 3.

In this conventional example, there is a problem that sensitivity to signals is insufficient even when signals in the FM broadcast band or a higher frequency band region than the FM are received. It is an object of the present invention to provide a glass antenna for an automobile which can eliminate the disadvantage of the conventional technique that sensitivity to signals is insufficient.

SUMMARY OF THE INVENTION

In accordance with the present invention, there is provided a glass antenna for an automobile in which an electric heating type defogger having a large number of heater strips and a plurality of bus bars, and an antenna conductor, are provided on a rear window glass sheet fitted to a rear window opening of an automobile. A part of the defogger and a part or the entirety of the antenna conductor are laid one upon another by interposing an insulation layer.

Further, there is provided a glass antenna for an automobile in which an electric heating type defogger having a large number of heater strips and a plurality of bus bars, and an antenna conductor, are provided on a rear window glass sheet fitted to a rear window opening of an automobile. The antenna conductor and at least one heater strip cross each other, and are laid one upon another by interposing an insulation layer in the crossing portion.

By adopting the above-mentioned constructions, the antenna conductor and the defogger achieve excellent capacitive coupling, and received signals in the defogger can be utilized effectively whereby sensitivity can be improved.

DETAILED DESCRIPTION OF THE PREFERRED EMBODIMENTS

Figure 1:
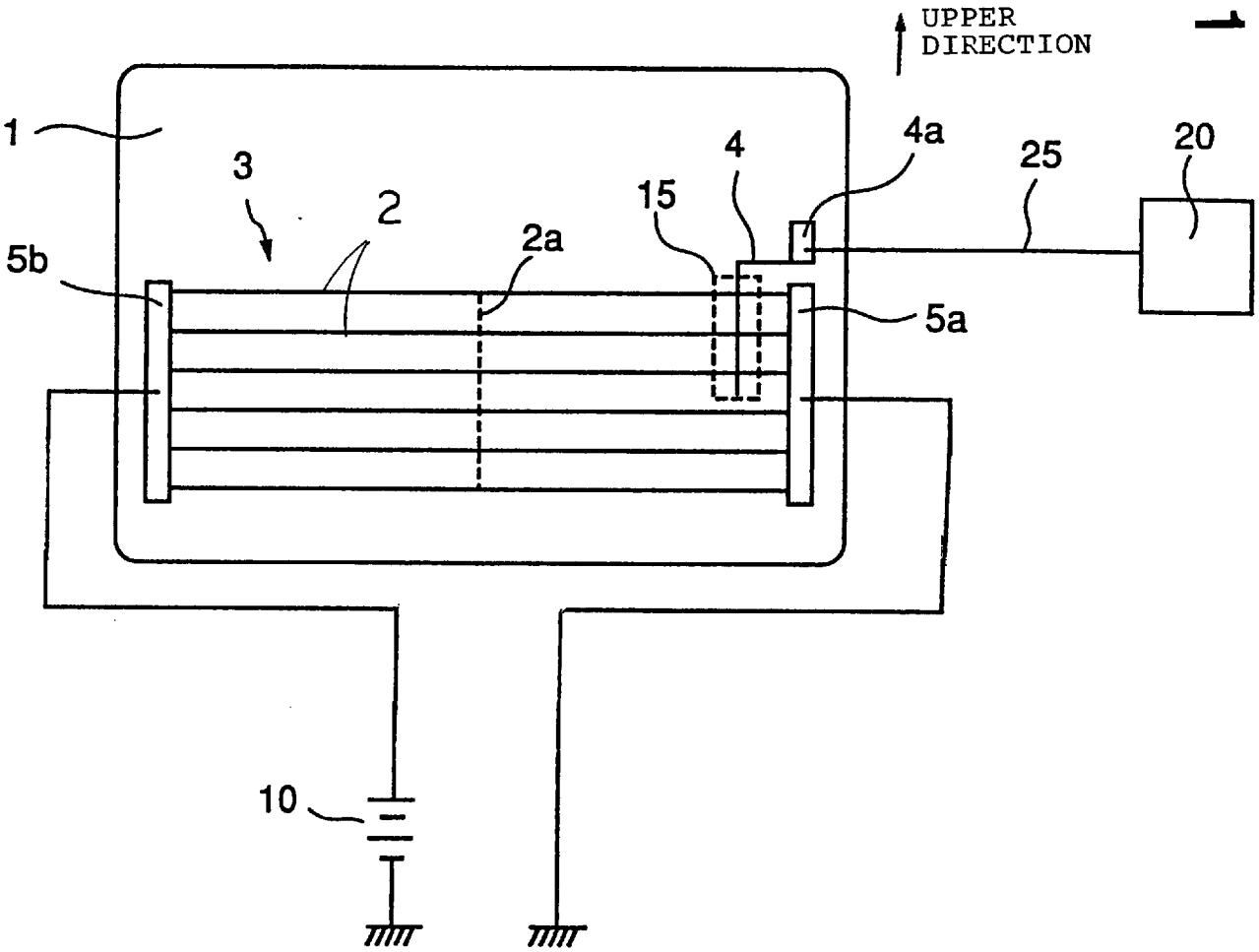
FIG. 1 is a diagram showing an embodiment of the glass antenna for an automobile according to the present invention.

FIG. 1 is a diagram showing the construction of an embodiment of the glass antenna for an automobile according to the present invention. In FIG. 1, an electric heating type defogger 3 comprising heater strips 2 and bus bars 5*a*, 5*b* and an antenna conductor 4 are provided in a rear window glass sheet 1 of an automobile. The glass antenna for an automobile shown in FIG. 1 is suitable for receiving signals in an FM broadcast band or a frequency band region having a higher frequency than the FM broadcast band. Received signals induced in the antenna conductor 4 are supplied to a receiver 20 via a power feeding point 4*a* and a cable 25. A direct current is fed from a direct current power source 10 to the defogger 3.

The power feeding point 4*a* is provided in the vicinity of a right circumferential portion of the rear window glass sheet 1 in a space above the defogger 3 in the rear window glass 1. However, the position of the power feeding point 4*a* is not limited to the position as shown in FIG. 1, but it may be at any position in the rear window glass sheet 1. For convenience in wiring the cable 25, it is preferable to dispose the power feeding point 4*a* in the vicinity of a circumferential portion of the rear window glass sheet 1.

In FIG. 1, the power feeding point 4*a* is arranged in a space above the defogger 3 in the rear window glass sheet 1. The antenna conductor 4 first extends from the power feeding point 4*a* toward a region around the center in a lateral direction of the rear window glass 1, and the extended portion is bend downwardly to form an extension. The antenna conductor 4 crosses a plurality of heater strips 2 in a portion of antenna conductor 4 which extended downwardly. In the crossing portion, the antenna conductor 4 and the heater strips 2 are laid one upon another by interposing an insulation layer 15 (indicated by a dotted line). Namely, the portion of antenna conductor which is extended downwardly crosses the heater strips.

As shown in the illustrated embodiments, insulation layer 15 may take the form of an insulation strip that is substantially narrower than dimensions of the rear window glass sheet.

Figure 16:
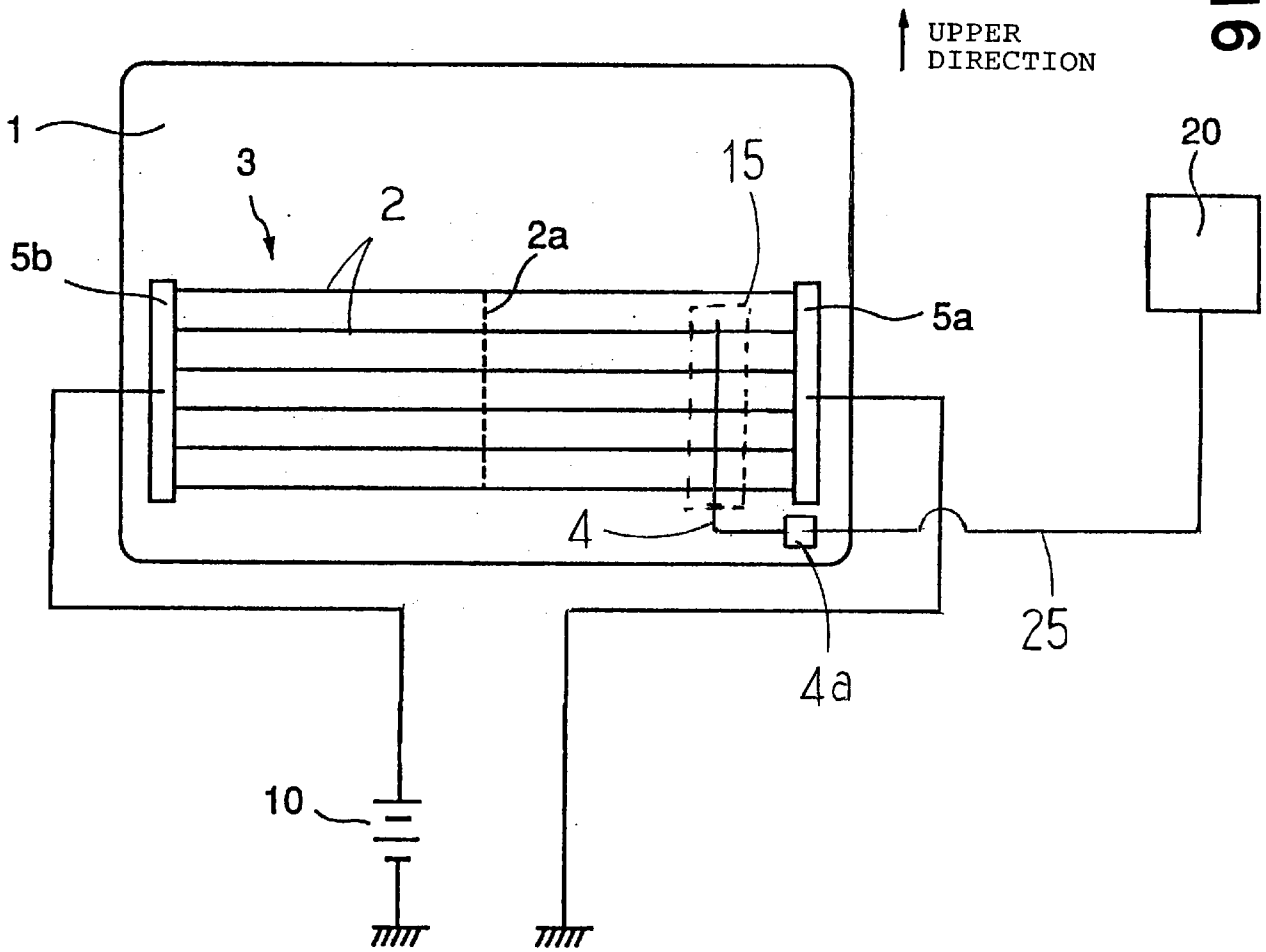
FIG. 16 is a diagram showing another embodiment according to the present invention.

A modified embodiment is shown in FIG. 16, in which the power feeding point 4*a* is arranged in a space below the defogger 3 in the rear window glass sheet 1; the antenna conductor 4 first extends from the power feeding point 4*a* toward a region around the center in a lateral direction of the rear window glass sheet 1, and the extended portion is bent upwardly to form an extension, and the upwardly extended portion of antenna conductor 4 crosses heater strips 2.

Figure 9:
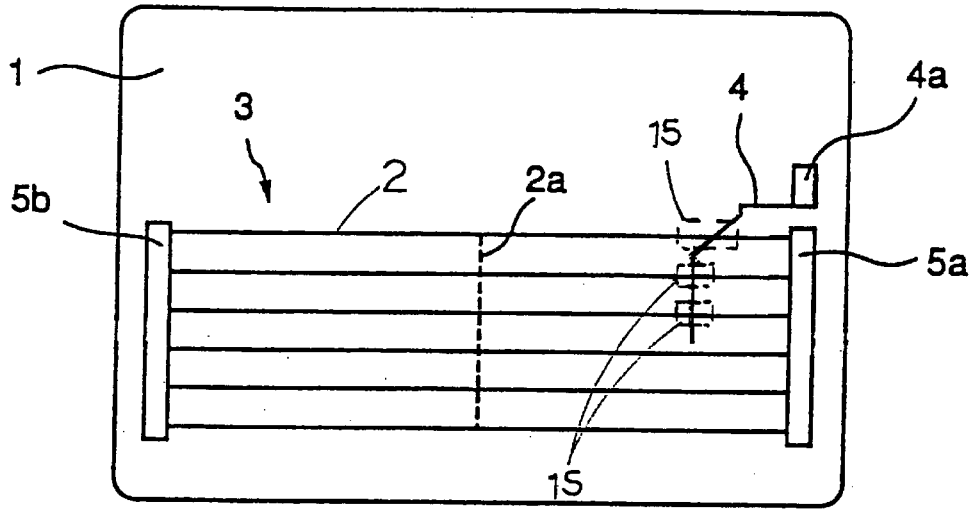
FIG. 9 is a diagram showing another embodiment according to the present invention.

In FIG. 1, the angle formed at the position where the antenna conductor 4 crosses the heater strips 2 is substantially a right angle. However, the angle is not limited thereto but the angle formed by the antenna conductor 4 and the heater strips 2 may have an optional angle. In FIG. 9, the angle formed at the position where the heater strip 2 at the highest position crosses the antenna conductor 4 is smaller than a right angle.

As shown in FIG. 1, it is preferable from the viewpoint of improving sensitivity that the antenna conductor 4 crosses a plurality of heater strips 2. However, the antenna conductor 4 is not limited to such arrangement, but it may be used even in a case that the antenna conductor 4 crosses only one heater strip 2.

When the antenna conductor 4 crosses only one heater strip 2, the length of a horizontal portion of the antenna conductor 4 is larger than a horizontal portion of the antenna conductor 4, and the length of a vertical portion is smaller than the vertical portion of the antenna conductor 4 shown in FIG. 1. Further, the presence of the insulation layer 15 interposed between the antenna conductor 4 and the heater strips 2 in the crossing portion forms a capacitive coupling between the antenna conductor 4 and the heater strips 2.

Although it is preferable that the antenna conductor 4 crosses the heater strips 2 in order to improve sensitivity, it is not necessary that the antenna conductor 4 crosses the heater strips. For example, the antenna conductor 4 and the heater strips 2 may be made to overlap by interposing an insulation layer 15 as shown in FIG. 7.

Figure 7:
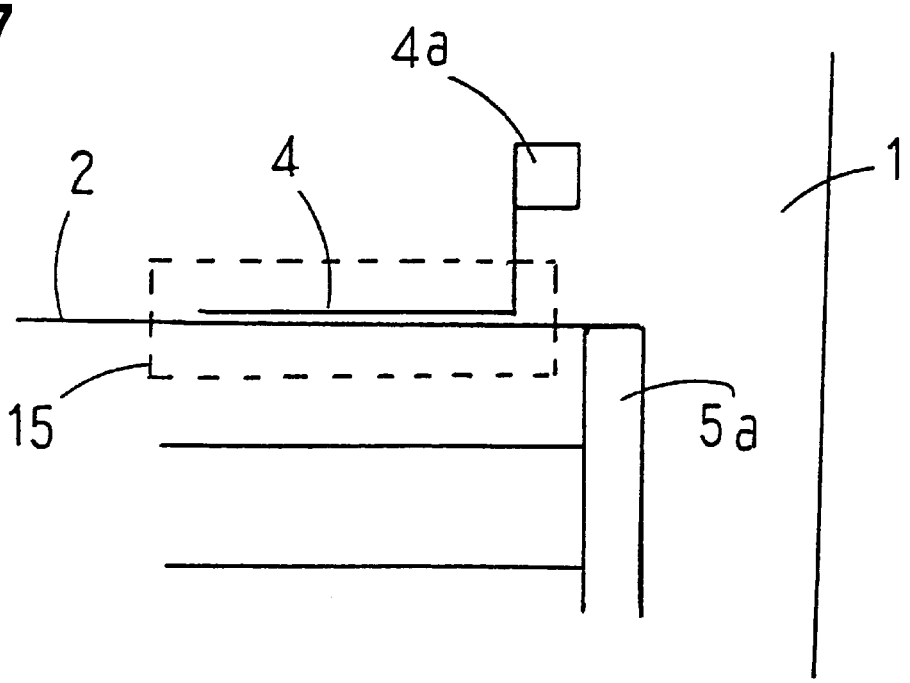
FIG. 7 is an enlarged view showing a part around the antenna conductor 4 in another embodiment according to the present invention.

In FIG. 7, a power feeding point 4*a* is arranged in a space above the defogger 3 in the rear window glass sheet 1. The antenna conductor 4 first extends from the power feeding point 4*a* downwardly; the downwardly extended portion is further bent toward the center in a lateral direction of the rear window glass sheet 1 to form an extension, and the extended portion is extended in the same direction as a heater strip 2 to overlap the heater strip 2 by interposing the insulation layer 15 between the heater strip 2 and the extended portion. For convenience, the portion where the antenna conductor 4 and the heat strip 2 overlap in a direction of the thickness of the glass sheet is shown by closely adjacent parallel lines in FIG. 7. Namely, the portion of the antenna conductor 4, which is bent toward the center in a lateral direction of the rear window glass sheet 1, overlaps a heater strip 2 and extends in the same direction as the heater strip 2, and the extended portion is laid to overlap the heater strip 2 by interposing the insulation layer 15 in the overlapping portion.

Figure 17:
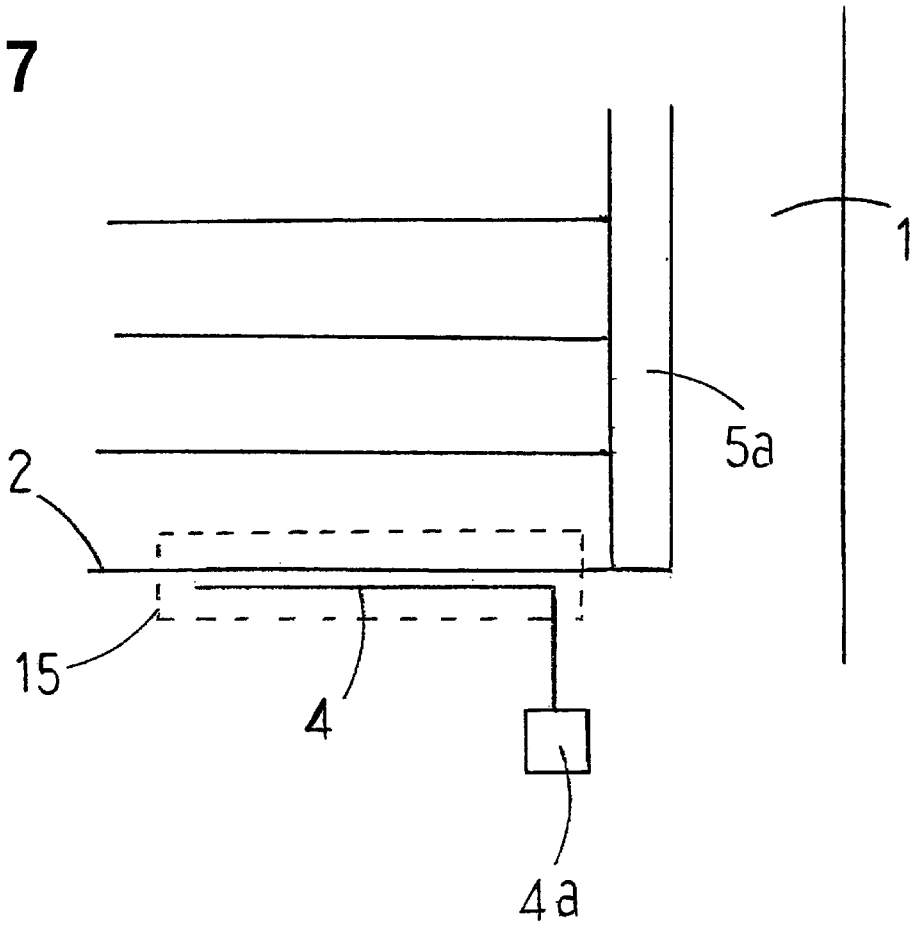
FIG. 17 is a diagram showing an important portion of another embodiment according to the present invention.

As a modification of the embodiment shown in FIG. 7, there is such a modified embodiment, as shown in FIG. 17, that the power feeding point 4*a* is arranged in a space below the defogger 3 in the rear window glass sheet 1; the antenna conductor 4 first extends from the power feeding point 4*a* upwardly, and the upwardly extended portion is bent toward the center in a lateral direction of the rear window glass sheet 1.

Figure 10:
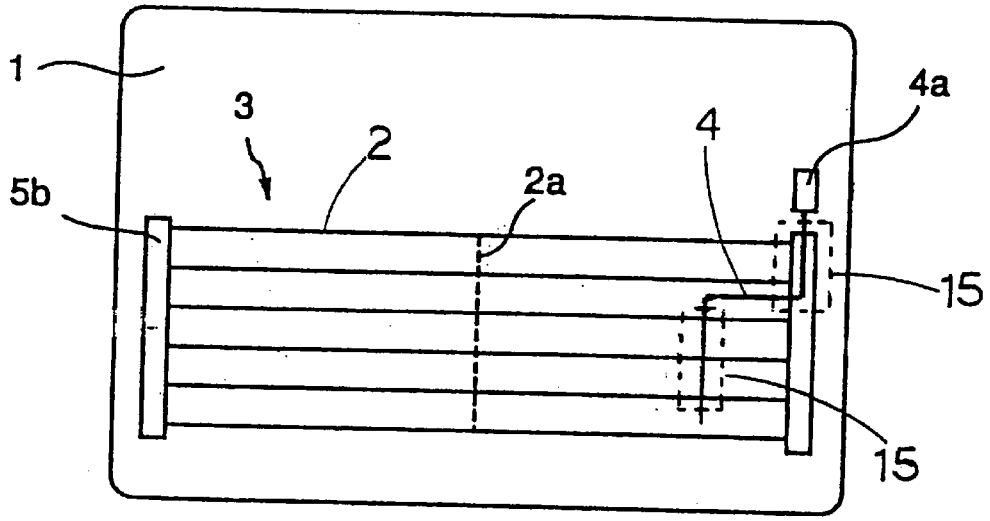
FIG. 10 is a diagram showing another embodiment according to the present invention.
Figure 11:
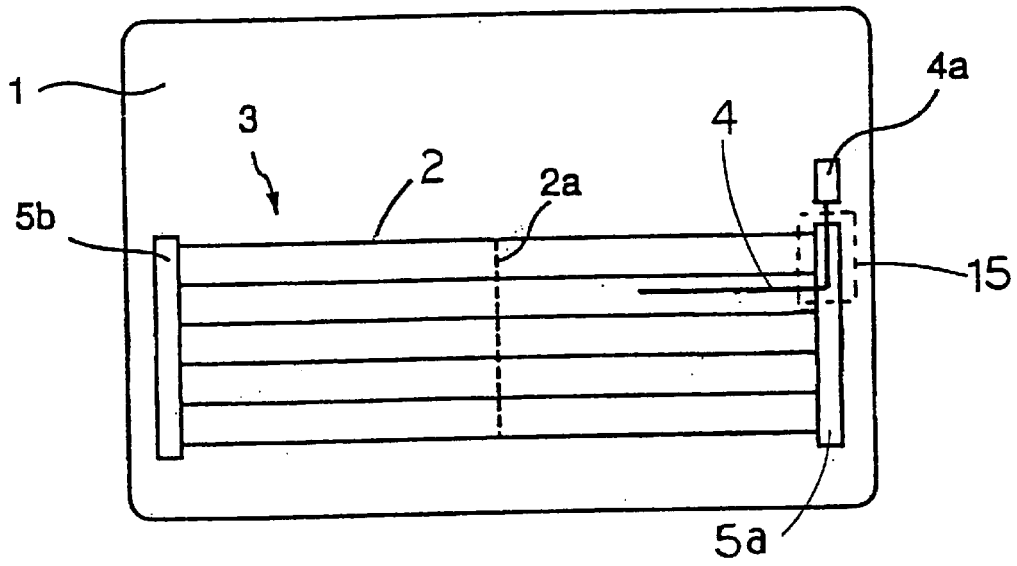
FIG. 11 is a diagram showing another embodiment according to the present invention.
Figure 12:
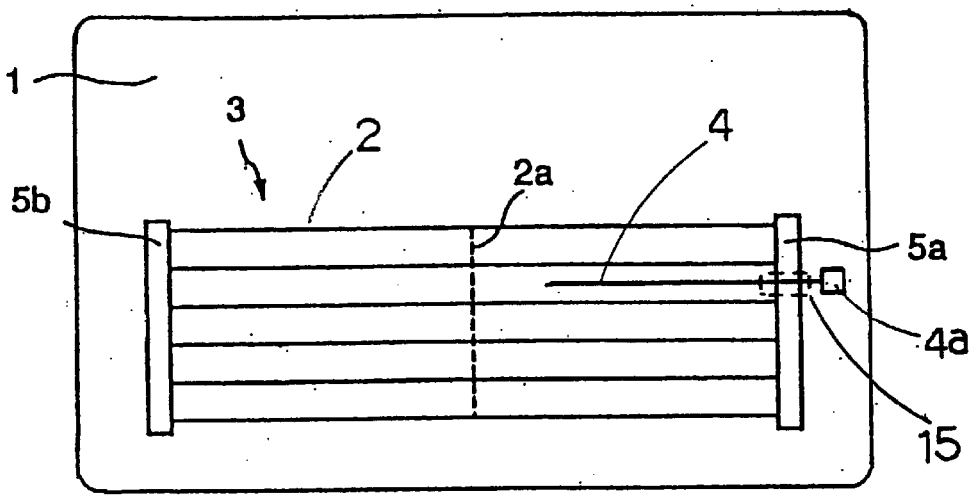
FIG. 12 is a diagram showing another embodiment according to the present invention.
Figure 13:
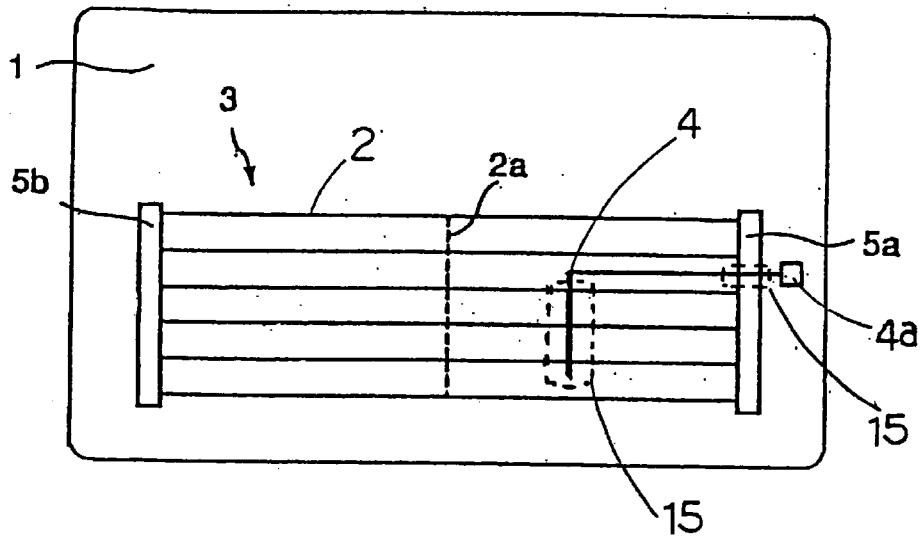
FIG. 13 is a diagram showing another embodiment according to the present invention. Preferred embodiments of the present invention will be described in detail with reference to the drawings.

The antenna conductor 4 has a portion extended in the same direction as the bus bar 5*a* or the bus bar 5*b*, and it may be laid to overlap the bus bar 5*a* and/or the bus bar 5*b* by interposing an insulation layer 15 in the extended portion (FIG. 10 and FIG. 11). Further, the antenna conductor 4 may be laid to cross the bus bar 5*a* and/or the bus bar 5*b* by interposing an insulation layer 15 (FIG. 12 and FIG. 13).

In the example of FIG. 9, a power feeding point 4*a* is arranged in a space above the defogger 3 in the rear window glass sheet 1, and the antenna conductor 4 first extends from the power feeding point 4*a* toward a region around the center in a lateral direction of the rear window glass sheet 1, and the extended portion is bent downwardly in an oblique direction toward the region around the center in a lateral direction of the glass sheet to form an extension.

The antenna conductor 4 crosses a heater strip 2 (a single heater strip 2 at the highest position in FIG. 9) in the portion of antenna conductor extended downwardly in an oblique direction. Further, after the antenna conductor 4 has been extended downwardly in an oblique direction, it is extended just downwardly. The just downwardly extended portion of the antenna conductor 4 crosses a plurality of heater strips 2 (two in FIG. 9). In the crossing portions, the antenna conductor 4 and each heater strip 2 are laid one upon another by interposing insulation layers 15 (dotted line).

In the example of FIG. 10, the antenna conductor 4 once extended from the feeding point 4*a* downwardly in the same direction as a bus bar 5*a* and is laid to overlap the bus bar between which an insulation layer 15 is interposed. Further, the extended portion is bent toward the region around the center in a lateral direction of the glass sheet, and is further bent downwardly to form an extension. The portion of the antenna conductor 4, which is bent downwardly and is extended in a vertical direction, crosses a plurality of heater strips 2 (three in FIG. 10). The antenna conductor 4 and the heater strips 2 are laid by interposing an insulation layer 15 (dotted line) in the crossing portions.

In the example of FIG. 11, the antenna conductor 4 first extends from the power feeding point 4*a* downwardly in the same direction as a bus bar 5*a* and is laid to overlap the bus bar between which an insulation layer 15 is interposed. The extended portion is further bent to extend toward the region around the center in a lateral direction of the glass sheet. The portion of the antenna conductor 4 extended toward the region around the center in a lateral direction of the glass sheet (a horizontal portion) is arranged between two adjacent heater strips substantially parallel to the heater strips.

In the example of FIG. 12, the power feeding point 4*a* is arranged between a bus bar and a side of the rear window glass sheet 1, and the antenna conductor 4 is extended horizontally from the power feeding point 4*a* toward the region around the center in a lateral direction of the glass sheet. The extended portion crosses the bus bar in a part, and the extended portion is laid to overlap the bus bar by interposing an insulation layer 15 in the crossing portion. The leading portion of the antenna conductor 4, which is ahead of the portion crossing the bus bar and extends toward the region around the center in a lateral direction of the glass sheet (a horizontal portion), is arranged between two heater strips substantially parallel to the heater strips.

In the example of FIG. 13, the power feeding point 4*a* is arranged between a bus bar and a side of the rear window glass sheet 1, and the antenna conductor 4 is extended horizontally from the power feeding point 4 toward the region around the center in a lateral direction of the glass sheet. The extended portion crosses the bus bar in a part, and the extended portion is laid to overlap the bus bar by interposing an insulation layer 15. The leading portion of the antenna conductor 4, which is ahead of the portion crossing the bus bar and extends toward the region around the center in a lateral direction of the glass sheet (a horizontal portion), is arranged between two adjacent heater strips substantially parallel to the heater strips. The horizontal portion of the antenna conductor 4 is further bent downwardly to form an extension in the way toward the region around the center in a lateral direction. The downwardly extended portion of the antenna conductor 4 crosses a plurality of heater strips 2 (three in FIG. 13). The antenna conductor 4 and the heater strips 2 are laid by interposing an insulation layer 15 (dotted line).

Figure 8:
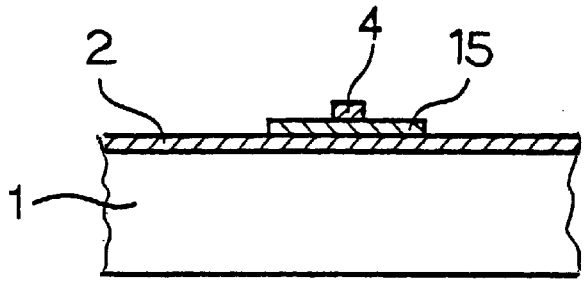
FIG. 8 is an enlarged cross-sectional view viewed from an upper side which shows a portion where the antenna conductor 4 and heater strips 2 cross, in FIG. 1.

In FIG. 1, the insulation layer 15 is laid on the heater strips 2 provided on the rear window glass sheet 1 in the crossing portions, and the antenna conductor 4 is laid on the insulation layer 15. FIG. 8 is an enlarged cross-sectional view from an upper portion which shows the portion where the antenna conductor 4 and a heater strip 2 cross.

The order of the lamination is not limited to that shown in FIG. 8. The lamination may be such that an antenna conductor 4 is provided on the rear window glass sheet 1; an insulation layer 15 is laid on the antenna conductor 4, and a heater strip 2 is laid on the insulation layer 15. As the material for the insulation layer 15, glass, ceramics or the like can be used.

In the glass antenna for an automobile shown in FIG. 1, a portion of each heater strip 2 in the region around the center in a lateral direction of the glass sheet is short-circuited with a short circuit line 2*a* (dotted line). The short circuit line 2*a* is provided as required. The short circuit line 2*a* functions to make the impedance of the defogger 3 stable in a case of using the defogger 3 as an antenna.

Figure 3:
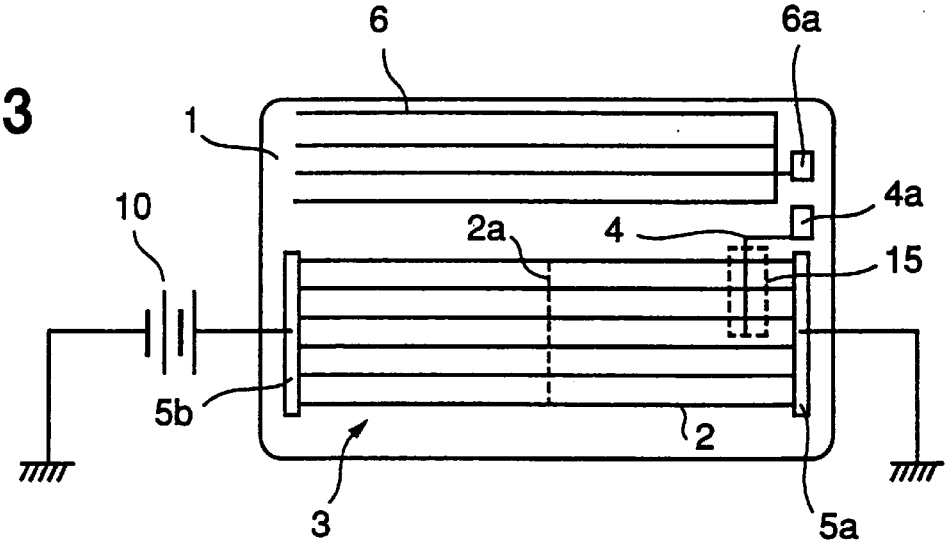
FIG. 3 is a diagram showing another embodiment according to the present invention.

FIG. 3 shows another embodiment of the present invention. In the example of FIG. 3, an antenna conductor 6 for a middle wave broadcast band (AM broadcast band) (520 to 1,700 kHz) which comprises four horizontal elements in parallel to the heater strips 2 is provided in a space above the defogger 3 in the rear window glass sheet 1, and a power feeding point 6a for the antenna conductor 6 for a middle wave broadcast band is provided above and in the vicinity of the power feeding point 6*a*. The cable 25 and the receiver 20 are omitted from the drawing. The construction of the glass antenna shown in FIG. 3 is the same as that in FIG. 1 except that the antenna conductor 6 for a middle wave broadcast band and the power feeding point 6*a* are provided.

Figure 4:
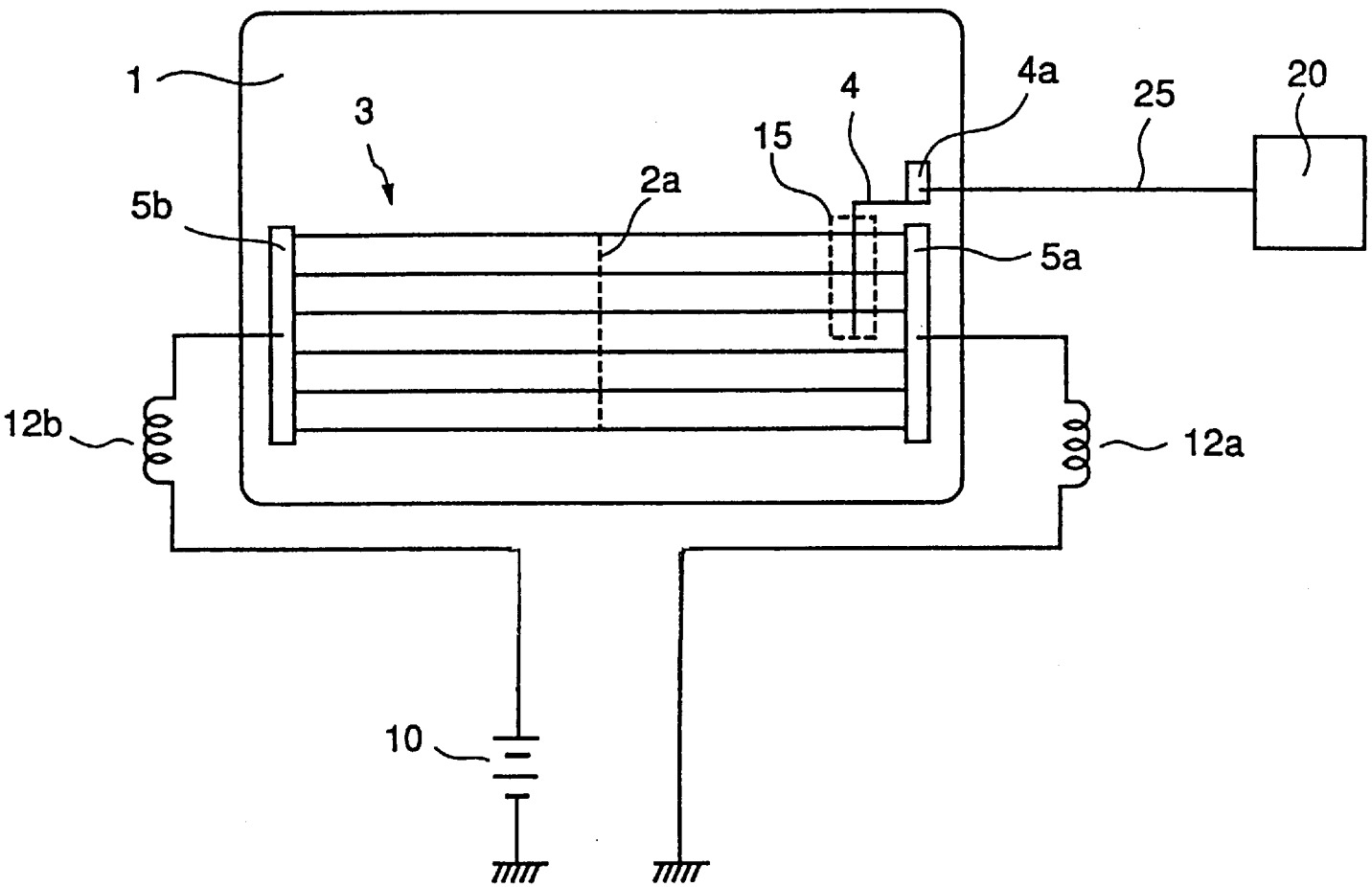
FIG. 4 is a diagram showing another embodiment according to the present invention.

FIG. 4 shows another embodiment of the present invention. In the example of FIG. 4, a high frequency choke coil 12*b* is inserted and connected in a line between a bus bar 5*b* and a direct current power source 10, and a high frequency choke coil 12*a* is inserted and connected in a line between a bus bar 5*a* and the ground. The structure shown in FIG. 4 is the same as that in FIG. 1 except that the high frequency choke coils 12*a*, 12*b* are provided as described above.

The high frequency choke coils 12*a*, 12*b* provide a high impedance in an FM broadcast band or a frequency band higher than the FM broadcast band. The high frequency choke coils 12*a*, 12*b* permit a direct current to flow from the direct current power source 10 to the defogger 3, but block a current of received signal in an FM broadcast band or a frequency band region having a higher frequency than the FM broadcast band. Since the antenna conductor 4 and the heater strips 2 are in a relation of capacitive coupling, a current of received signal induced in the antenna conductor 4 is permitted to flow to the defogger 3. However, the leaking of a current to the automobile body through the defogger 3 is prevented by such blocking effect. Further, a current of received signal induced in the defogger 3 is prevented from leaking to the automobile body.

Figure 5:
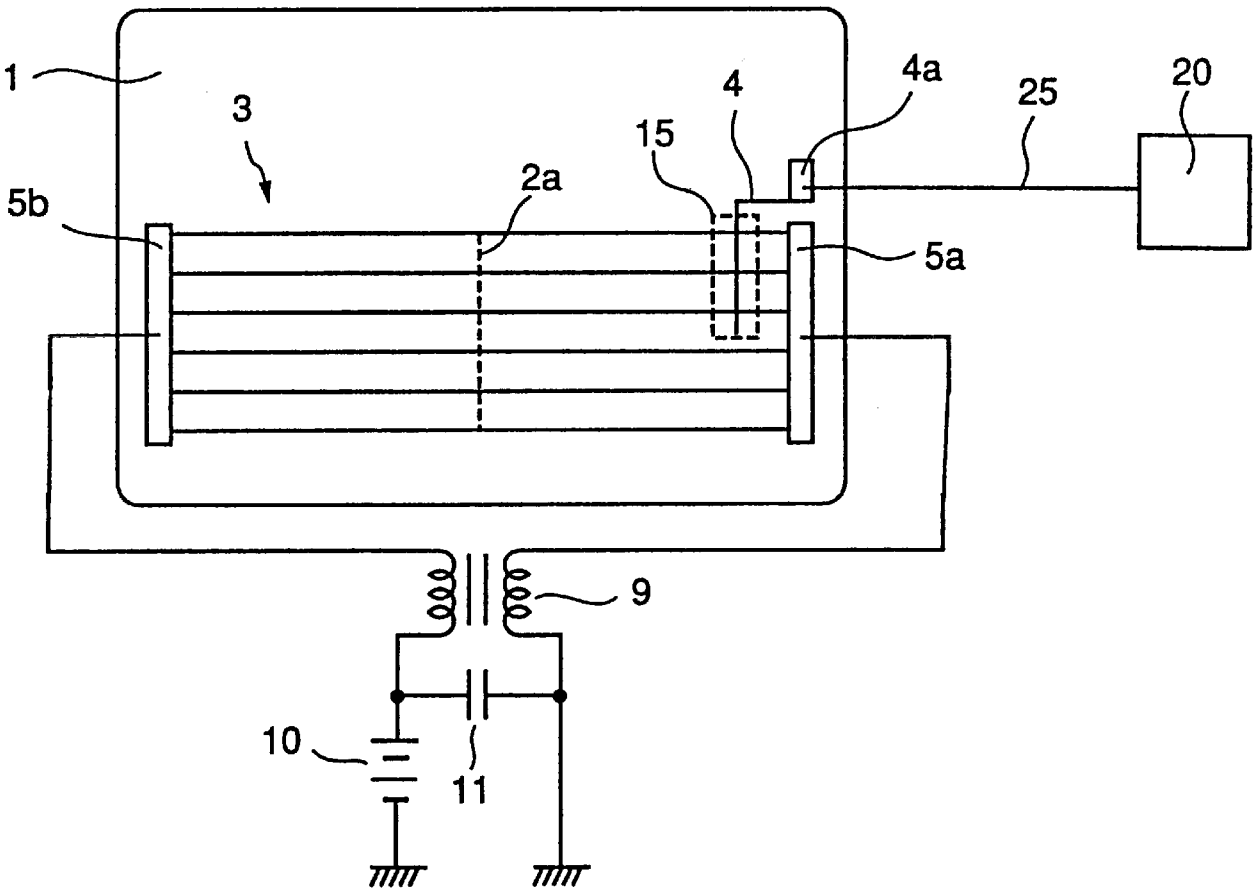
FIG. 5 is a diagram showing another embodiment according to the present invention.

FIG. 5 shows another embodiment of the present invention. In the example of FIG. 5, a choke coil 9 is inserted and connected in a line between a bus bar 5*b* and a direct current power source 10, and the choke coil 9 is inserted and connected in a line between a bus bar 5*a* and the ground. A capacitor 11 is inserted and connected between the direct current power source 10 and the ground. The construction shown in FIG. 5 is the same as that in FIG. 1 except that the choke coil 9 and the capacitor 11 are provided as described above.

The choke coil 9 provides a high impedance in a middle wave broadcast band, whereby a direct current is permitted to flow from the direct current power source 10 to the defogger 3. However, a current of received signal in the middle wave broadcast band is blocked by the choke coil 10. Since the antenna conductor 4 and the heater strips 2 are in a relation of capacitive coupling, a current of received signal in the middle wave broadcast band induced in the antenna conductor 4 is permitted to flow to the defogger 3. However, the current is prevented from leaking to the automobile body through the defogger 3 by such blocking effect. Further, a current of received signal in the middle wave broadcast band induced in the defogger 3 is prevented from leaking to the automobile body. Namely, the antenna conductor 4 shown in FIG. 5 can supply a received signal in a middle wave broadcast band to the receiver.

Figure 6:
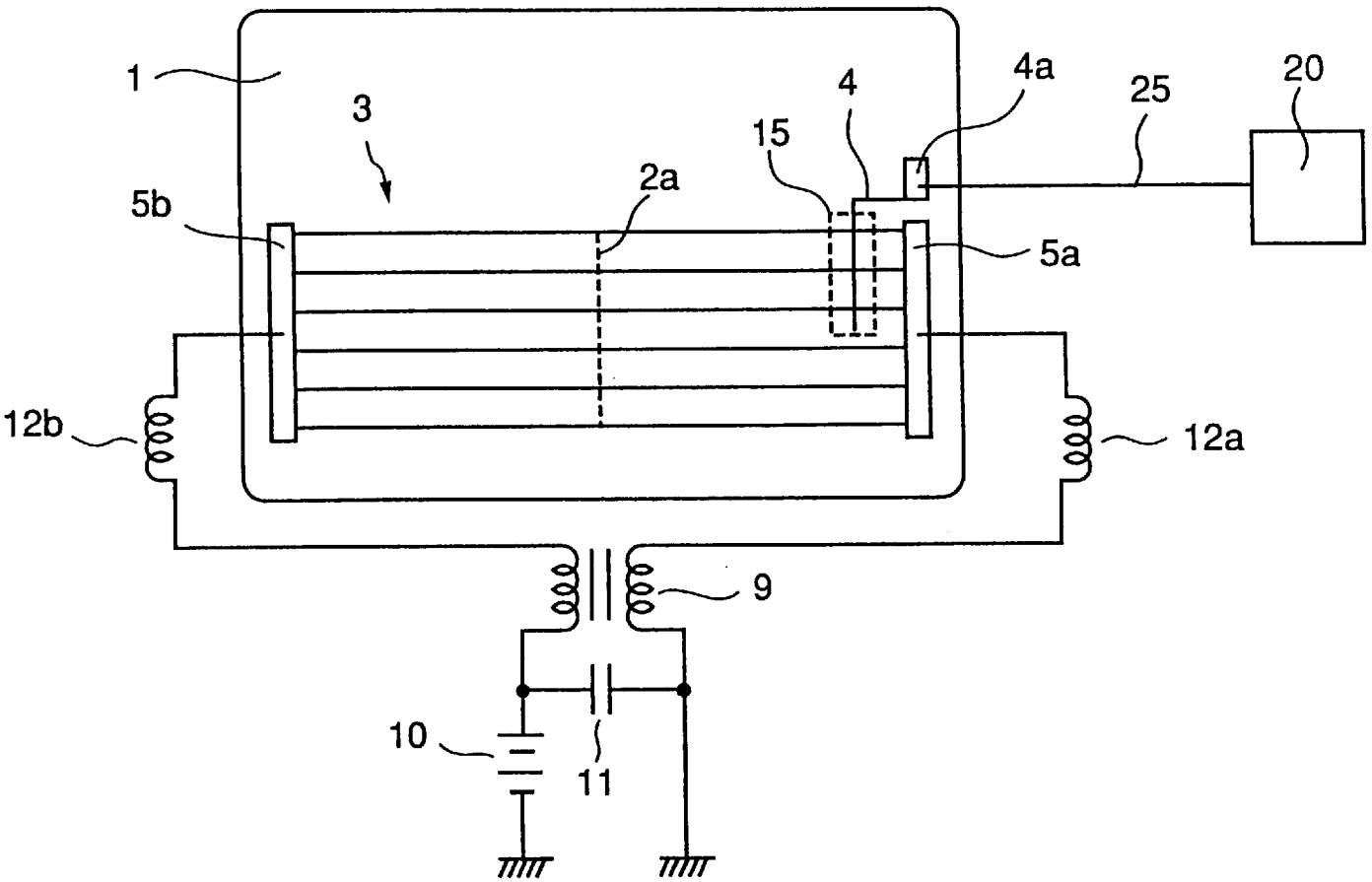
FIG. 6 is a diagram showing another embodiment according to the present invention.

FIG. 6 shows another embodiment of the present invention. In the example of FIG. 6, a series connection circuit of a high frequency choke coil 12*b* and a choke coil 9 is inserted and connected in a line between a bus bar 5*b* and a direct current power source 10, and a series connection circuit of a high frequency choke coil 12*a* and the choke coil 9 is inserted and connected in a line between a bus bar 5*a* and the ground. The construction shown in FIG. 6 is the same as that in FIG. 1 except that the above-mentioned two series connection circuits and a capacitor 11 are provided.

By wiring as in FIG. 6, a current of received signal in a middle wave broadcast band, an FM broadcast band and a frequency band region having a higher frequency than the FM broadcast band, induced in the antenna conductor 4 and the defogger 3 is prevented from leaking to the automobile body. Namely, the antenna conductor 4 in FIG. 5 can supply a received signal in a middle wave broadcast band, an FM broadcast band and a frequency band region having a higher frequency than the FM broadcast band to the receiver.

In the pattern of the antenna conductor 4 in the present invention, a pattern which can provide the optimum performance as an antenna for a middle wave broadcast, an FM broadcast, a radio broadcast for an FM broadcast and an FM broadcast in common, television or another broadcast, is designed appropriately in consideration of the shape of an automobile and the shape, the dimension and the construction of a glass sheet and so son.

Namely, the present invention is not limited to the construction as shown in FIG. 1 in which the antenna conductor 4 has a pattern of substantially L-like letter, but a pattern having any shape can be used. The shape of the antenna conductor is not in particular limited, but a pattern formed by a single or a plurality of linear lines, curved lines, or the like, may be used. Further, a pattern including a looped conductor may be used.

In FIGS. 1, 3, 4, 5 and 6, the antenna conductor 4 may be provided at any position in the glass sheet 1 as far as it overlaps the defogger 3, and there is no limitation to the positions as shown in FIGS. 1, 3, 4, 5 and 6. The number of antenna conductors provided in the rear window glass sheet 1 other than the antenna conductor 4 is not limited.

The antenna conductor 4 shown in FIGS. 1, 3, 4, 5 and 6 is not provided with an auxiliary antenna conductor. However, the present invention is not limited thereto, and an auxiliary antenna conductor having a substantially T-like letter, a substantially L-like letter, a looped form or the like may be provided in the conductor pattern of the antenna conductor 4 or the power feeding point 4*a* with or without a connecting conductor for the purpose of phase adjustment or directivity adjustment. Further, the shape of the insulation layer 15 is rectangular in FIGS. 1, 3, 4, 5, and 6. However, the present invention is not limited thereto, but it may be substantially circular, substantially elliptic, triangle or the like.

An antenna peripheral circuit such as an impedance matching circuit, a preamplifier circuit, an oscillation circuit or the like may be inserted and connected, according to requirements, in at least one selected from a line between the power feeding point 4*a* and the receiver and a line between the power feeding point 6*a* and the receiver.

The present invention can be used, other than a middle wave broadcast band and an FM broadcast band, for a long wave broadcast band (LW band) (150 to 280 kHz), a short wave broadcast band (2.3 to 26.1 MHZ), an FM broadcast band in U.S.A. (88 to 108 MHZ), a VHF band for television (90 to 108 MHZ and 170 to 222 MHZ), a UHF band for television (470 to 770 MHZ), a 800 MHZ band for vehicle telephone (810 to 960 MHZ), a 1.5 GHz band for vehicle telephone (1.429 to 1.501 GHz), a UHF band (300 MHZ to 3 GHz), 1575.42 MHZ for GPS signal from GPS satellite, VICS (vehicle information and communication system) and so on.

The glass antenna for an automobile according to the present invention can be prepared by the following method in which a transfer means is used, for example. Namely, patterns are heat-transferred from transfer papers on which patterns of a conductor and an insulation layer are printed to a rear window glass sheet as a substrate. The transfer paper comprises a base paper and an easily separable layer formed on the base paper. A pattern of antenna conductor and so on, which is to be formed on the rear window glass sheet, is printed on the easily separable layer. For the pattern of the antenna conductor, paste containing an electric conductive metal such as a silver paste or the like is used. For the pattern of the insulation layer, ceramic paste, glass paste or the like is used.

For example, when the glass antenna for an automobile shown in FIG. 1 is prepared by using the transfer means, a pattern of the defogger 3 is previously printed on the rear window glass sheet 1. Then, patterns of the antenna conductor 4 and the insulation layer 15 are printed in this order on the easily separable layer on the base papers. The transfer papers on which the patterns of the antenna conductor 4 and the insulation layer 15 are printed are successively put on the rear window glass sheet 1; the transfer paper is pressed under a predetermined pressure by means of a pressing plate; the base paper is heated, and only the base plate is removed.

The defogger shown in FIG. 1 is a defogger having a Λ-like shape. However, the defogger according to the present invention is not limited to that shown in FIG. 1, but may have a defogger having a ⊐ "reverse squared-off C" shape as shown in FIG. 15, instead of the defogger 3 shown in FIG. 1, to perform the same effect.

Figure 15:
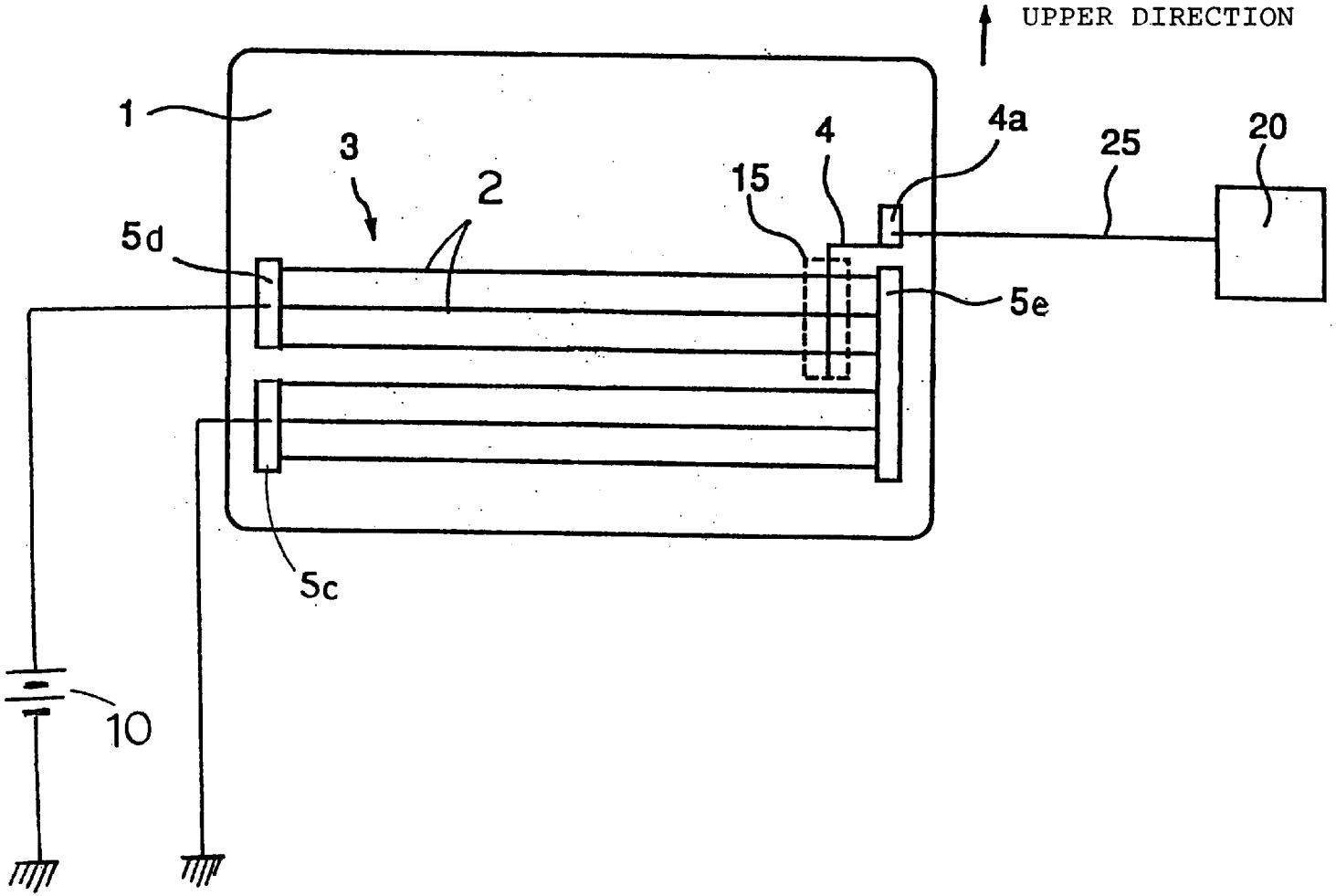
FIG. 15 is a diagram showing another embodiment according to the present invention.

In the defogger shown in FIG. 15, a left side of the defogger 3 comprises a lower bus bar 5*c* and an upper bus bar 5*d*. The bus bar 5*c* is connected to the automobile body as the earth and the bus bar 5*d* is connected to the anode of the direct current power source. A supplied current flows in a ⊐ "reverse squared-off C" form from the bus bar 5*d* through a right side bus bar 5*e* to the bus bar 5*c*.

EXAMPLES

Example 1

A rear window glass sheet for an automobile was used, and a glass antenna for an automobile as shown in FIG. 1 was prepared. However, in stead of 6 heater strips 2 in FIG. 1, 12 heater strips 2 was formed, and the antenna conductor 4 was crossed to upper 6 heater strips 2. Further, all 12 heater strips were connected by means of a short circuit line 2*a*.

Figure 14:
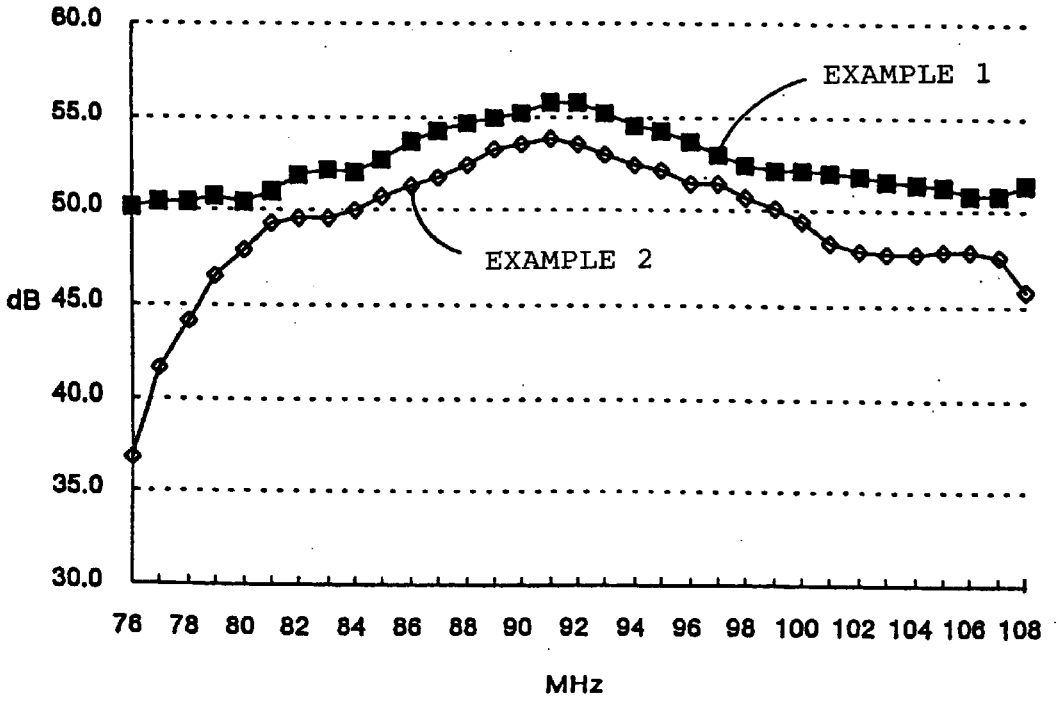
FIG. 14 is a frequency-sensitivity characteristic diagram in an FM broadcast band in Examples 1 and 2.

For the material for the insulation layer 15, glass composed of a mixture of barium silicate glass and lead glass as the main component was used. The specific dielectric constant of the insulation layer 15 was 6.3, and the dielectric loss of the insulation layer 15 was 0.01. The length of the antenna conductor 4 (excluding the power feeding point 4*a*) was 55 mm in its horizontal portion and 200 mm in its vertical portion. The space between adjacent heater strips 2 was 30 mm. FIG. 14 shows frequency to sensitivity characteristics in which the abscissa represents frequency and the ordinary represents sensitivity.

Example 2 (Comparative Example)

Figure 2:
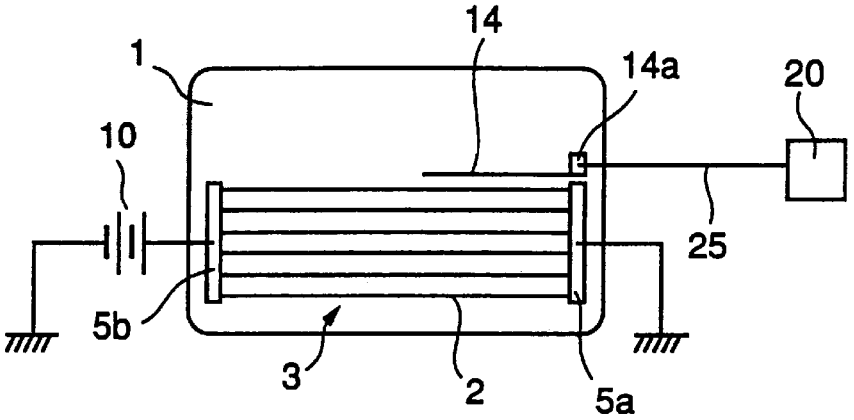
Fig. 2 PRIOR ART
FIG. 2 is a diagram showing the construction of a conventional example.

A rear window glass sheet for an automobile was used, and a glass antenna for an automobile shown in FIG. 2 was prepared. However, the defogger 3 was the same as in Example 1. The length of the antenna conductor 14 (excluding the power feeding point 14*a*) was 425 mm. The distance between the antenna conductor 14 and the heater strip 2 at the highest position was 20 mm. FIG. 14 shows the frequency-sensitivity characteristics.

In accordance with the present invention, a part of the defogger and a part or the entirety of the antenna conductor are laid one upon another by interposing an insulation layer. Accordingly, the antenna conductor and the defogger perform capacitive coupling preferably, whereby a received signal in the defogger can effectively be used and the sensitivity is improved.

What is claimed is:

1. A glass antenna for an automobile, comprising:

an electric heating type defogger having a large number of heater strips and a plurality of bus bars, and an antenna conductor provided on a rear window glass sheet fitted to a rear window opening of the automobile, wherein:

a) a part of the defogger and a part or the entirety of the antenna conductor overlap where an insulation layer is interposed;

b) the insulation layer constitutes an insulation strip substantially narrower than dimensions of the rear window glass sheet; and c) the antenna conductor includes at least one of:

i) a first portion extending in a same direction as a heater strip and overlapping the heater strip where the insulation layer is interposed; and ii) a second portion overlapping a bus bar where the insulation layer is interposed.

2. The glass antenna for an automobile according to claim 1, wherein:

a power feeding point for the antenna conductor is above the defogger in the rear window glass sheet; and the antenna conductor first extends from the power feeding point downwardly and thereafter bends toward a center in a lateral direction of the rear window glass sheet.

3. The glass antenna for an automobile according to claim 1, wherein:

the antenna conductor extends in a same direction as a bus bar; and the insulation layer is interposed in an overlapping portion between the antenna conductor and the bus bar.

4. The glass antenna for an automobile according to claim 1, wherein:

a power feeding point for the antenna conductor is below the defogger in the rear window glass sheet; and the antenna conductor extends from the power feeding point upwardly and thereafter bends toward a center in a lateral direction of the rear window glass sheet.

5. A glass antenna for an automobile, comprising:

an electric heating type defogger having a large number of heater strips and a plurality of bus bars, and an antenna conductor provided on a rear window glass sheet fitted to a rear window opening of the automobile, wherein:

a) the antenna conductor and at least one heater strip overlap where an insulation layer is interposed;

b) the insulation layer constitutes an insulation strip substantially narrower than dimensions of the rear window glass sheet; and c) the antenna conductor includes at least one of:

i) a first portion extending in a same direction as a heater strip and overlapping the heater strip where the insulation layer is interposed; and ii) a second portion overlapping a bus bar where the insulation layer is interposed.

6. The glass antenna for an automobile according to claim 5, wherein:

a power feeding point for the antenna conductor is above the defogger in the rear window glass sheet; and the antenna conductor first extends from the power feeding point toward a region around a center in a lateral direction of the rear window glass sheet, and thereafter bends downwardly to form an extension that overlaps at least one of the heater strips.

7. The glass antenna for an automobile according to claim 6, wherein:

an angle formed where the antenna conductor overlaps the heater strips is substantially a right angle.

8. The glass antenna for an automobile according to claim 5, wherein:

a power feeding point for the antenna conductor is above the defogger in the rear window glass sheet; and the antenna conductor first extends from the power feeding point toward a region around a center in a lateral direction of the rear window glass sheet, thereafter bends downwardly in an oblique direction toward the region around the center in a lateral direction of the glass sheet to form an extension that overlaps at least one of the heater strips.

9. The glass antenna for an automobile according to claim 5, wherein:

the antenna conductor extends in a same direction as a bus bar; and the insulation layer is interposed in an overlapping portion between the antenna conductor and the bus bar.

10. The glass antenna for an automobile according to claim 5, wherein:

an angle formed where the antenna conductor overlaps the heater strips is substantially a right angle.

11. The glass antenna for an automobile according to claim 5, wherein:

a power feeding point for the antenna conductor is below the defogger in the rear window glass sheet; and the antenna conductor first extends from the power feeding point toward a region around a center in a lateral direction of the rear window glass sheet, and thereafter bends upwardly to overlap at least one of the heater strips.

12. A glass antenna for an automobile having a rear window glass sheet, the glass antenna comprising, on the rear window glass sheet:

an electric heating type defogger having a large number of heater strips and a plurality of bus bars;

an antenna conductor; and an insulating layer interposed where a part of the defogger and at least part of the antenna conductor overlap;

wherein:

a power feeding point for the antenna conductor is above the defogger in the rear window glass sheet;

the antenna conductor first extends from the power feeding point downwardly and thereafter bends toward a center in a lateral direction of the rear window glass sheet;

a portion of antenna conductor that is bent toward the center in the lateral direction of the rear window glass sheet, overlaps at least one heater strip and extends in a same direction as the heater strip that it overlaps; and the insulation layer is interposed in an overlapping portion between the antenna conductor and the heater strip.

13. A glass antenna for an automobile having a rear window glass sheet, the glass antenna comprising, on the rear window glass sheet:

an electric heating type defogger having a large number of heater strips and a plurality of bus bars;

an antenna conductor; and an insulating layer interposed where a part of the defogger and at least part of the antenna conductor overlap;

wherein:

a power feeding point for the antenna conductor is above the defogger in the rear window glass sheet;

the antenna conductor first extends from the power feeding point downwardly in a same direction as a bus bar and overlaps the bus bar where the insulation layer is interposed, and thereafter bends in a horizontal direction toward a region around a center in a lateral direction of the rear window glass sheet; and a horizontally extended portion of the antenna conductor is arranged between and substantially parallel to two adjacent heater strips.

14. A glass antenna for an automobile having a rear window glass sheet, the glass antenna comprising, on the rear window glass sheet:

an electric heating type defogger having a large number of heater strips and a plurality of bus bars;

an antenna conductor; and an insulating layer interposed where the antenna conductor and at least one heater strip overlap;

wherein:

a power feeding point for the antenna conductor is above the defogger in the rear window glass sheet; and the antenna conductor first extends from the power feeding point downwardly to overlap a bus bar where the insulation layer is interposed, and thereafter bends in a horizontal direction toward a region around a center in a lateral direction of the rear window glass sheet between and substantially parallel to two adjacent heater strips, and finally bends downwardly to overlap at least one of the heater strips.

15. A glass antenna for an automobile having a rear window glass sheet, the glass antenna comprising, on the rear window glass sheet:

an electric heating type defogger having a large number of heater strips and a plurality of bus bars;

an antenna conductor; and an insulating layer interposed where a part of the defogger and at least part of the antenna conductor overlap;

wherein:

a power feeding point is arranged between a bus bar and a side of the rear window glass sheet;

the antenna conductor extends horizontally from the power feeding point toward a region around a center in a lateral direction of the glass sheet to overlap the bus bar where the insulation layer is interposed; and a leading portion of antenna conductor ahead of a portion overlapping the bus bar is arranged between and substantially parallel to two adjacent heater strips.

16. A glass antenna for an automobile having a rear window glass sheet, the glass antenna comprising, on the rear window glass sheet:

an electric heating type defogger having a large number of heater strips and a plurality of bus bars;

an antenna conductor; and an insulating layer interposed where the antenna conductor and at least one heater strip overlap;

wherein:

a power feeding point is arranged between a bus bar and a side of the rear window glass sheet;

the antenna conductor extends horizontally from the power feeding point toward a region around a center in a lateral direction of the glass sheet to overlap the bus bar where the insulation layer is interposed; and a leading portion of antenna conductor ahead of a portion overlapping the bus bar is arranged between and substantially parallel to two adjacent heater strips, and thereafter bends downwardly to overlap at least one of the heater strips.

* * * * *